United States Patent [19]

Blanchard

[11] 4,384,866

[45] May 24, 1983

[54] PROCESS FOR PRODUCING DURABLE PRESS FABRICS THROUGH PHOSPHORYLATION

[75] Inventor: Eugene J. Blanchard, New Orleans, La.

[73] Assignee: The United States of America as represented by the Secretary of Agriculture, Washington, D.C.

[21] Appl. No.: 385,204

[22] Filed: Jun. 4, 1982

[51] Int. Cl.[3] ..... D06M 13/40; D06M 11/08

[52] U.S. Cl. ..... 8/115.7; 8/116 P

[58] Field of Search ..... 8/115.7, 116 P

[56] References Cited

U.S. PATENT DOCUMENTS

| | | | |
|---|---|---|---|
| 2,524,783 | 10/1950 | Ford et al. | 8/116 P |
| 3,488,140 | 1/1970 | Gallagher . | |
| 3,970,425 | 7/1976 | LeBlanc et al. | 8/116 P |
| 4,207,068 | 6/1980 | Blanchard et al. | 8/116 P |
| 4,331,437 | 5/1982 | Remley | 8/116 P |

OTHER PUBLICATIONS

LeBlanc, Textile Chemist and Colorist, vol. 7, No. 2, pp. 31–33, 1975.

*Primary Examiner*—Maria Parrish Tungol
*Attorney, Agent, or Firm*—M. Howard Silverstein; David G. McConnell; Raymond C. Von Bodungen

[57] ABSTRACT

This invention provides a method for the treatment of cellulose containing fabrics with inorganic phosphorylating agents to obtain durable press or smooth drying fabrics. The method involves treating the cellulose-containing material with 8–16% of an inorganic phosphate, 16–32% of urea, 0.5–2.0% of a catronically emulsified polyethylene fabric softener, 0–6% of a polyacrylate or suitable polymer emulsion (glass transition temperature: −20° to −43° C.), and then drying the fabric at 60°–100° C. for 3–7 minutes. The fabric is crosslinked to obtain durable press or smooth drying properties by curing at 160°–170° C. for 3–9 minutes.

9 Claims, No Drawings

PROCESS FOR PRODUCING DURABLE PRESS FABRICS THROUGH PHOSPHORYLATION

BACKGROUND OF THE INVENTION (1) Field of the Invention

This invention relates to a process for producing durable press cotton-containing fabrics. More specifically it relates to the phosphorylation of cellulose with inorganic phosphorylating agents in the presence of urea.

(2) Description of the Prior Art

The unusual method for producing durable press cotton-containing fabric is to treat the material with an N-methylol compound, such as dimethylol dihydroxyethyleneurea or similar type agent, by a pad, dry, cure technique. Upon curing, ether linkages are introduced which set the cellulose chains so that the fabric tends to remain in the shape in which it was cured. This results in a smooth drying or durable press fabric, which is evident after the fabric is washed and tumble dried.

Phosphorylation of cellulose has been used mainly for producing flame retardant and ion exchange fabrics. LeBlanc, Textile Chemist and Colorist, Vol. 7, No. 2, pp. 31–33, 1975, demonstrated that diammonium phosphate in combination with antimony oxide, polymer additive, and urea was useful for producing a flame retardant cotton textile. The ion exchange characteristics of the treated fabric were also described. Gallgher, U.S. Pat. No. 3,488,140, June 1970 demonstrated the use of alkali-metal or condensed phosphate salts for imparting flame retardant and soil release properties to cellulose.

Heretofore, phosphorylation with inorganic phosphoylating agents to produce wrinkle free fabrics has not be described.

SUMMARY OF THE INVENTION

A process is disclosed for producing durable-press fabrics by treating cotton-containing materials with inorganic phosphorylating agents in the presence of urea and polyethylene fabric softener, drying, and then curing at elevated temperatures.

DESCRIPTION OF THE PREFERRED EMBODIMENTS

We have found that cellulose-containing fabrics can be given durable press properties, which allows the to be essentially smooth drying and wrinkle free after washing and tumble drying, by treating with inorganic phosphorylating agent in the presence or urea and cationically emulsified polyethylene fabric softener. The inorganic phosphorylating agents are selected from the group consisting of dibasic ammonium phosphate ($[NH_4]_2HPO_4$), monobasic ammonium phosphate ($NH_4H_2PO_4$), and monobasic sodium phosphate ($NaH_2PO_4$). They may be used from about 8% to 16% by weight of the aqueous treatment formulation. The urea, which is necessary for promoting the reaction with cellulose and for reducing fabric degradation during curing, is used from about 16% to 32% by weight of the aqueous solution. The cationically emulsified polyethylene fabric softener is used from about 0.5% to 2% by weight of the aqueous solution. In the instant invention a low density cationically emulsified polyethylene was used. A polyacrylate emulsion or other polymer emulsion, such as butadiene-styrene, can also be used to enhance durable press properties of the fabric. The polymer is used from about 2% to 6% by weight of the aqueous formulation. The polyacrylate used in the preferred embodiment had a glass transition temperature of −20° C. and the butadiene-styrene polymer had a glass transition temperature of −43° C. Glass transition temperatures in the range from about −20° to −50° C. are necessary for obtaining phosphorylated fabric with durable press ratings higher than 3.0. Fabrics containing polymers with higher glass transition temperatures will have a stiffer handle and the smooth drying performance will suffer. Other polymer emulsions whose films have glass transition temperatures in the specified range can be expected to give similar performance.

The polymers can also be used in a two step process in which the fabric is initially treated with ideally 2–6% of the polymer, and then dried at 60°–100° C. for 3–7 minutes. The fabric is then treated with the phosphorylating formulating as described herein and then cured to promote fabric resiliency.

The method for producing phosphorylated fabric to obtain durable press properties consists of the following steps: (1) treating cellulose containing material with an inorganic phosphate, urea, and polyethylene emulsion (a polymer emulsion can also be included in the formulation): (2) the fabric is dried at 60°–100° C. for 3–7 minutes; (3) the fabric is cured at 160°–170° C. for 3–9 minutes to obtain durable press properties.

After washing in a conventional washing machine and tumble drying the fabrics were evaluated for durable press properties according to the procedure listed in the Technical Manual of the American Association of Textile Chemists and Colorists, 1968, Test Method 8A–1964, pag B-111. According to this method fabrics are rated for durable press properties on a scale of 1 to 5 with 5 having the highest degree of smoothness. In this invention, fabrics were considered to have an adequate degree of durable press when the ratings were in excess of 3.0 after washing and tumble drying. The wrinkle recovery angle of the fabrics was measured according to Test Method 66–1968, page B-173 of the same manual. Both of these methods are important for proper evaluation of the fabrics to determine the performance level.

At low levels of phosphoryating agent in the formulation, fabric resiliency is improved if the cotton-containing fabric has been treated with liquid ammonia. This mercerization treatment results in durable press ratings of greater than 3.0 with only 8% phosphorylating agent in the treating solution.

The following examples further describe the invention. They are given as illustration and should not be considered as limiting the scope of the invention.

EXAMPLE 1

A desized, scoured, and bleached cotton print cloth was treated with 100 g of an aqueous solution composed of 15 g $NH_4H_2PO_4$, 30 g urea, 1 g cationically emulsified polyethylene, (Velvetol 77–27, Quaker Chemical Corporation), and 54 g water. The fabric was dried at 100° C. for 3 minutes and cured at 160° C. for 7 minutes. The durable press rating of the fabric after washing and tumble drying was 3.3 and the conditioned wrinkle recovery angle was 287° (warp and fill)

EXAMPLE 2

A desized, scoured, and bleached cotton print cloth was treated with phosphorylating agent as in Example 1 except the phosphorylating agent used was $(NH_4)_2HPO_4$. After washing and tumble drying the fabric had a durable press rating of 3.3 and a wrinkly recovery angle of 268°.

EXAMPLE 3

A desized, scoured, and bleached cotton print cloth was treated with phosphorylating agent as in Example 1 except the phosphorylating agent used was $NaH_2PO_4$. After washing and tumble drying the fabric had a durable press rating of 3.2 and a conditioned wrinkle recovery angle of 258°.

EXAMPLE 4

Cotton fabric was treated with phosphorylating agent as in Example 1 except the fabric was dried at 60° C. for 7 minutes and cured at 170° for 4 minutes. The durable press properties of the fabric were the same as obtained in Example 1.

EXAMPLE 5

A desized, scoured, and bleached cotton print cloth, which was mercerized with liquid ammonia, was treated with 100 g of an aqueous formulation composed of 8 g $NH_4H_2PO_4$, 16 g urea, 1 g cationically emulsified polyethylene, and 75 g water. The fabric was dried and cured as in Example 1. After the fabric was washed and tumble dried, the durable press rating was 3.3 and the conditioned wrinkle recovery angle was 248°.

EXAMPLE 6

A desized, scoured, and bleached cotton print cloth was treated with 100 g of an aqueous formulation composed of 15 g $NH_4H_2PO_4$, 30 g urea, 1 g cationically emulsified polyethylene, 2 g emulsified polyacrylate (K87, Rohm & Haas Co.) with a glass transition temperature of −20° C., and 52 g water. The sample was dried and cured, and then laundered as in Example 1. The durable press rating was 3.5 and the conditioned wrinkle recovery angle was 295°.

EXAMPLE 7

A desized, scoured, and bleached cotton print cloth was treated as in Example 6 except the formulation included 6 g of the emulsified polyacrylate. The durable press rating was 3.8 and the conditioned wrinkle recovery angle was 299°.

EXAMPLE 8

A cotton fabric was treated with an aqueous formulation as in Example 6 except 2 g of an emulsified butadiene-styrene polymer (2600×171, B. F. Goodrich) was used instead of the polyacrylate. After drying, curing, and laundering the fabric properties were about the same as obtained in Example 6.

EXAMPLE 9

A cotton fabric was treated with an aqueous formulation composed of 3 g of an emulsified polyacrylate. The fabric was dried at 60° C. for 7 minutes and then treated with an aqueous formulation composed of 8 g $NH_4H_2PO_4$, 16 g urea, 1 g emulsified polyethylene, and 75 g water. The fabric was dried at 60° C. for 7 minutes and cured at 160° C. for 7 minutes. After washing and tumble drying the fabric had a durable press rating of 3.3 and a conditioned wrinkle recovery angle of 276°.

EXAMPLE 10

A cotton fabric was treated with an aqueous formulation composed of 3 g of an emulsified butadiene-stryene polymer. The fabric was dried as in Example 9 and then treated with a formulation composed of 12 g $(NH_4)_2HPO_4$, 24 g urea, 1 g emulsified polyethylene, and 63 g water. The fabric was dried and cured as in Example 9. After washing and tumble drying the durable press rating was 3.3 and the conditioned wrinkle recovery angle was 294°.

EXAMPLE 11

A 50/50 cotton/polyester blend fabric was treated with phosphorylating agent as in Example 1. The durable press rating was 3.5 and the conditioned wrinkle recovery angle was 283°.

EXAMPLE 12

A 50/50 cotton/polyester blend fabric was treated with 100 g of an aqueous formulation composed of 12 g $NH_4H_2PO_4$, 24 g urea, 1 g cationically emulsified polyethylene, 6 g emulsified polyacrylate (Tg=−20° C.) and 57 g water. The durable press rating was 3.5 and the conditioned wrinkle recovery angle was 304.

We claim:

1. A process for producing a cellulose-containing textile with smooth drying properties, said process comprising:

a. treating a cellulose-containing textile with an aqueous formulation of an inorganic phosphorylating agent, urea, and cationically emulsified polyethylene fabric softener; and then b. drying and curing the textile.

2. The process of claim 1 wherein the cellulose-containing textile is cotton or cotton/polyester fabric.

3. The process of claim 1 wherein the inorganic phosphorylating agent is selected from the group consisting of dibasic ammonium phosphate, monobasic ammonium phosphate, and monobasic sodium phosphate.

4. The process of claim 1 wherein the aqueous formulation in (a) includes a polymer emulsion.

5. The process of claim 4 wherein the polymer emulsion is a polyacrylate with a glass transition of −20° C.

6. The process of claim 4 wherein the polymer emulsion is a butadiene-styrene polymer with a glass transition temperature of −43° C.

7. The process of claim 1 wherein the cellulose-containing textile in (a) is initially treated with an aqueous formulation containing a polymer emulsion.

8. The process of claim 7 wherein the polymer emulsion is a polyacrylate with a glass transition temperature of −20° C.

9. The process of claim 7 wherein the polymer emulsion is a butadiene-styrene with a glass transition temperature of −43° C.

* * * * *